US005814842A

United States Patent [19]

Muldoon et al.

[11] Patent Number: 5,814,842

[45] **Date of Patent: *Sep. 29, 1998**

[54] JACKING DEVICE ADAPTED FOR PANEL INSTALLATION

[76] Inventors: Christopher K. Muldoon, 1696 Sheridan Rd., South Euclid, Ohio 44121; Daniel H. Dieckman, 2666 Stiegler Rd., Valley City, Ohio 44280; John V. Pastva, 10839 Holliston La., Parma Heights, Ohio 44130

[ * ] Notice: The terminal 13 months of this patent has been disclaimed.

[21] Appl. No.: 320,174

[22] Filed: Oct. 7, 1994

[51] Int. Cl.[6] ..... B66F 3/00

[52] U.S. Cl. ..... 254/131

[58] Field of Search ..... 254/131, 8 B; 269/166–171.5, 79

[56] References Cited

U.S. PATENT DOCUMENTS

| | | | |
|---|---|---|---|
| 301,881 | 7/1884 | Goodloe . | |
| 1,041,660 | 10/1912 | Nelson | 254/131 |
| 1,694,173 | 12/1928 | Goranson . | |
| 2,692,753 | 10/1954 | Masterson, Jr. et al. . | |
| 2,877,815 | 3/1959 | Fonken | 269/171 |
| 2,896,910 | 7/1959 | Cooper et al. . | |
| 2,904,309 | 9/1959 | Mayville | 254/131 |
| 2,989,286 | 6/1961 | Gillespie . | |
| 3,155,255 | 11/1964 | Daniel | 254/131 |
| 4,010,931 | 3/1977 | Wheeler . | |
| 4,043,536 | 8/1977 | Almond . | |
| 4,336,927 | 6/1982 | Goff et al. | 269/171.5 |
| 4,868,943 | 9/1989 | Robichaud . | |

FOREIGN PATENT DOCUMENTS

| | | | |
|---|---|---|---|
| 2216245 | 10/1972 | Germany | 254/8 B |
| 120894 | 2/1948 | Sweden | 254/131 |
| 2225769 | 6/1990 | United Kingdom | 254/131 |

*Primary Examiner*—Robert C. Watson

[57] ABSTRACT

A lift for positioning and supporting a work item vertically during installation while fastening devices are put in place includes a base member, a pivoting lever member supported by a pivot in the base member and a locking device for locking the lever member at a selected position. The lever member includes a pedal portion sized to receive a workboot of a worker. The locking device includes a jamming wedge received through an aperture in the lever member whereby concurrent bias by the workboot on the pedal portion and against the locking device raises the lever member and locks the lever member at the selected position. An alternative embodiment uses a pawl and ratchet assembly as the jamming wedge.

15 Claims, 3 Drawing Sheets

JACKING DEVICE ADAPTED FOR PANEL INSTALLATION

BACKGROUND OF THE INVENTION

This invention pertains to the field of tools, and more particularly to a tool useful for lifting and positioning items such as wallboard sheets or panel configured items to a selected position.

The invention is especially applicable to an infinitely positionable jacking device operable by a single foot of a worker to set a work item like a sheet of wallboard or similar building panels, vertically into position while the necessary screws or fasteners are put in place. However, it will be appreciated by those skilled in the art that the invention could be readily adapted for use in other environments as, for example, where similar lift jack arrangements are employed for lifting or positioning other types of items.

Where a conventional work tool is employed for lifting and supporting panels such as a drywall panel into a vertically raised position for installation, such a tool will typically require the worker using the tool to keep his foot on the device so that his weight will provide the proper bias on a lever portion of the tool to maintain the panel in the raised position. The tool requires the worker to be with the tool while the necessary fasteners are put in place to support the panel. Only after securing the panel can the worker release his foot from the tool, so that the lever will fall from the fastened panel and the tool can then be positioned to raise and position another panel. Such tool arrangements have been constructed of a very simple base and lever assembly, wherein the lever pivots on the base about a centrally disposed pivot member.

Such prior art lift jack arrangements have suffered from various problems. In particular, since the tool requires the maintenance of a foot pressure on the lever to continue to support the panel in the selected position, the range of movement of the worker for fastener installation is obviously limited to the immediate proximity of the tool. Oftentimes this is inadequate to properly fasten the panel to a desired surface so that a single worker cannot carry out the installation task. Rather, several workers must, in combination with the tool and the panel, support the panel during the installation of the appropriate fastening devices. Another problem resulting from the continuing necessity to maintain the worker's weight on the lever is the problem of worker fatigue and slippage. Where the tool is free to continue to pivot, but for the pressure of the worker's foot, the panel can slip from the selected position if the worker's foot slips or the worker tires in the continued application of his weight on the lever. Lastly, in those circumstances where large wall panels are to be installed, and where a combination of prior art lift jack devices are employed, attainment of a selected position for the panel can be difficult where several workers must, in combination, independently operate separate tools to achieve the selected position and additional workers are necessary to attach the appropriate fastening devices.

The present invention contemplates a new and improved lift tool which overcomes all of the above-referred to problems and others to provide a tool which is simple in design, economical to manufacture, readily adaptable to a plurality of types of workpieces having a variety of dimensional characteristics, easy to operate, easy to remove, and which provides improved and more stable positioning of workpieces in an installation operation.

BRIEF SUMMARY OF THE INVENTION

In accordance with the present invention, there is provided a lift tool to position and support drywall, similar building panels and other materials vertically into position while the necessary screws or fasteners are put into place. The tool comprises a base member, a pivoting lever member supported by a pin in the base member and a locking device for locking the lever member in a selected position relative to the base member. The lever member includes a pedal portion sized to receive the foot of a worker and the locking device includes a jamming wedge received through an aperture in the lever member whereby concurrent bias by the foot of the worker on the pedal portion and against the locking device pushes the lever member and locks the lever member at the selected position relative to the base member. The foot of the worker can then be removed from the lift tool and the tool will remain in the locked position and continue to support the workpiece at the selected position. To remove the tool, the worker need only knock the side of the wedge with his boot to jar the jamming wedge and loosen it from its locked position in the aperture so that the locking device will be released and the lever member can collapse.

In accordance with another aspect of the present invention, the jamming wedge includes a second pedal portion at a first end portion, a slide at an intermediate portion and a base engaging end at a second end portion. The slide comprises an elongate member received through the lever aperture so that an infinite number of locking positions can be achieved by the tool. The base engaging end includes an arcuate bend disposed to align a terminal end of the jamming wedge substantially flush against a top wall of the base member.

In accordance with a further aspect of the invention, the locking device means comprises a combination of the jamming wedge being angularly biased through a slot in the top wall of the lever member so that first and second operatively spaced engagement points are realized for locking contact of the jamming wedge in the aperture, together with a locking contact of the terminal end of the jamming wedge against the top wall of the base member to maintain the lever member in the selected position even when the foot of the worker is removed from the pedal portion of the lever.

In accordance with yet another aspect of the present invention, the jamming wedge is alternatively configured to comprise a pawl and ratchet assembly including a rotatable pawl pivotably mounted on the lever member and a ratchet plate fixed to the base member. The pawl is configured to gravitationally rotate to the ratchet plate for locking engagement therewith as the lever member is raised. A release arm on the pawl is accessible to selectively release the pawl from the ratchet plate.

One benefit obtained by use of the present invention is an infinitely positionable jacking device that is easily operable with respect to positioning and locking of the device in a selected position with a single foot of a worker. The jacking device is locked in the preselected position by concurrent biasing of a lever pedal portion of the lever member and a locking member pedal portion on the locking device means until the lever member is pivoted to the selected position. An intermediate portion of the locking device means is then pinch locked in the aperture simultaneously with the terminal end engaging the top wall of the base so that the foot of the worker can be removed and the weight of the workpiece will continue to bias the jacking device to remain locked in the selected position.

Another benefit obtained from the present invention is a lift tool which allows the operator freedom of movement away from the tool for more easy application of fasteners to a workpiece supported in the selected position.

A further benefit of the present invention is a lift tool which can be independently operated so that a plurality of such lift tools can be used to selectively position a rather large wall panel so that a single worker can successfully install such a panel by himself.

Other benefits and advantages of the subject new lift tool device will become apparent to those skilled in the art upon a reading and understanding of this specification.

BRIEF DESCRIPTION OF THE DRAWINGS

The invention may take physical form in certain parts and arrangements of parts, the preferred embodiments of which will be described in detail in the specification and illustrated in the accompanying drawings which form a part hereof and wherein.

DETAILED DESCRIPTION OF THE INVENTION

Figure 2:
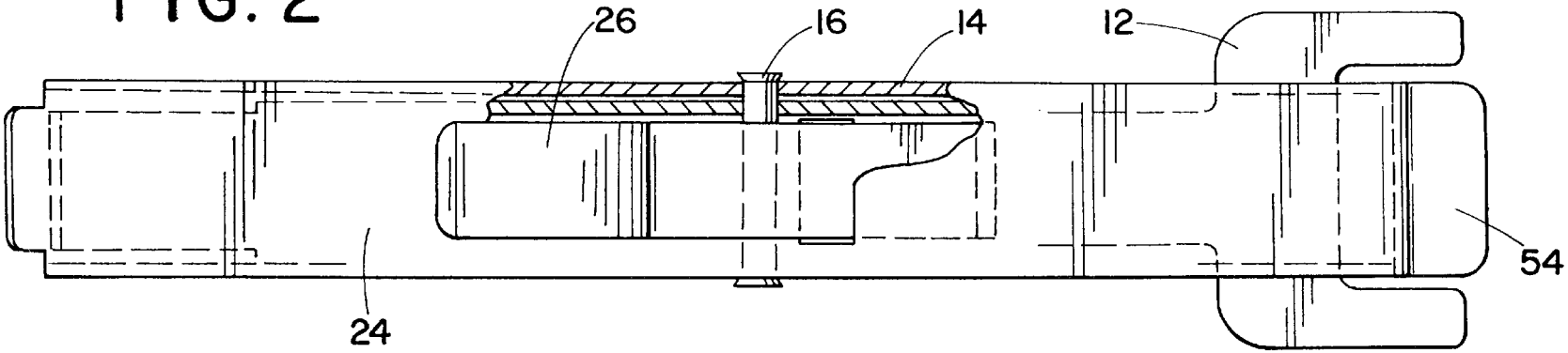
FIG. 2 is a top planar view in partial section.

Referring now to the drawings, wherein the showings are for purposes of illustrating the preferred embodiments of the invention only, and not for purposes of limiting same, the FIGURES show a lift tool 10 particularly useful as an infinitely positionable jacking device for positioning and locking sheets of drywall, similar building panels or other materials vertically into a position while the necessary screws or fasteners are put in place. The tool comprises a base member 12, a pivoting lever member 14 supported by a pivot or pin 16 in the base 12 and a locking device 18 received through an aperture 20 which cooperates with the lever 14 at the aperture 20 and the base member 12 to lock the tool in a selected position, as will hereinafter will be more fully explained.

Figure 1:
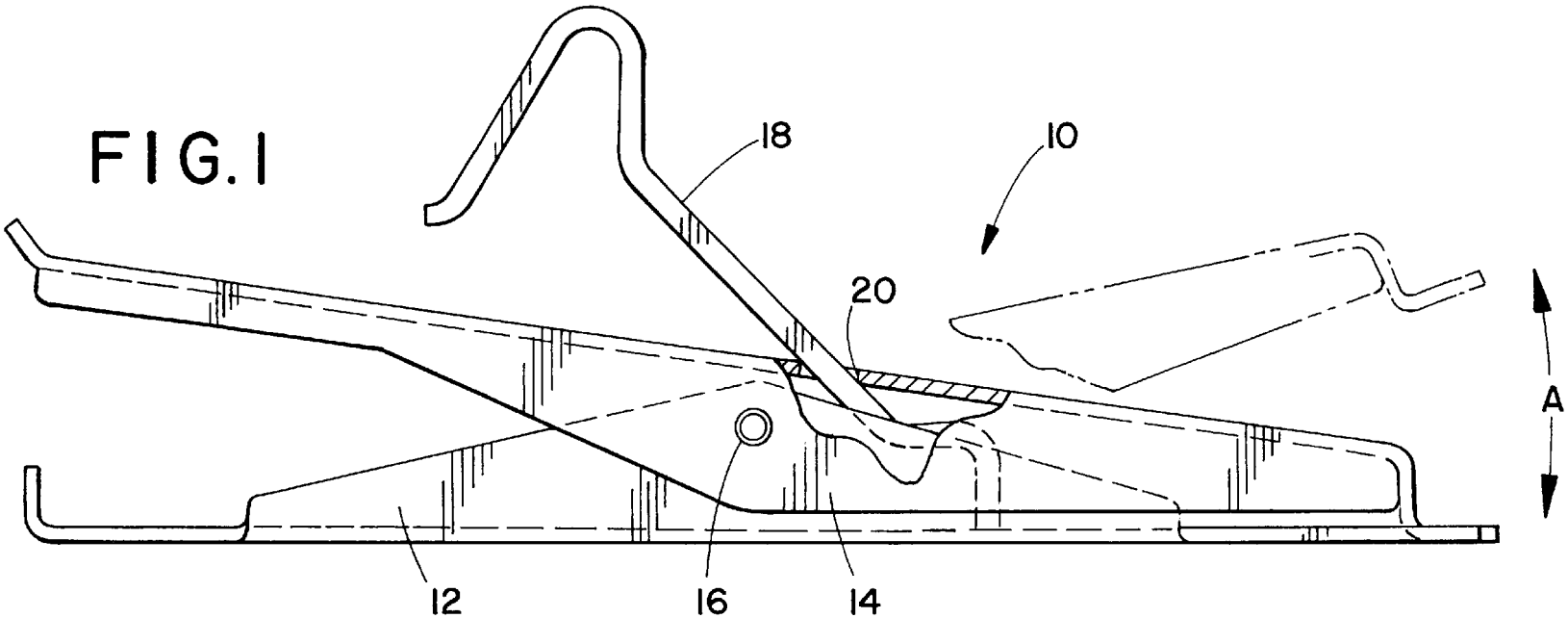
FIG. 1 is a side elevational view in partial section showing the lever member in a first and second position.

FIG. 1 shows that the lever 14 can have a range of movement at its terminal end defined by the arc A.

Figure 3:
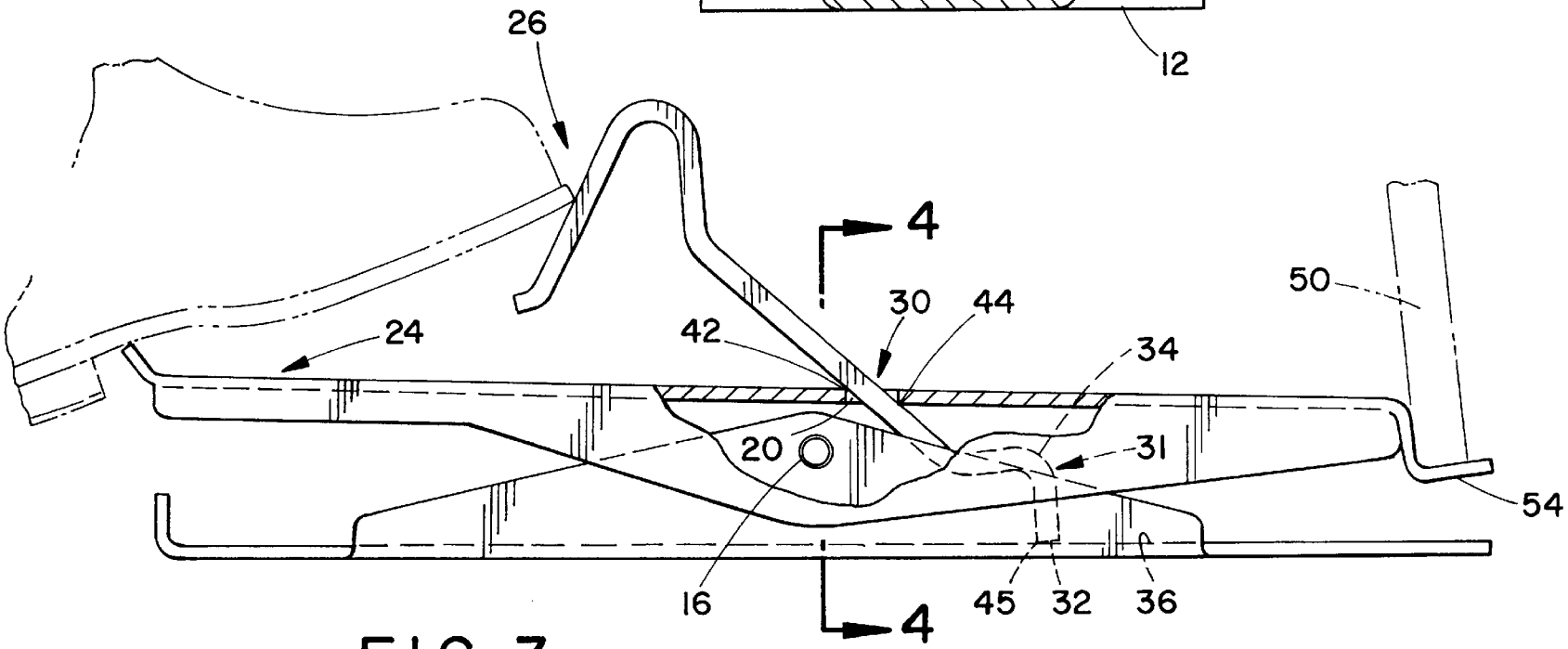
FIG. 3 is a side elevational view showing the device in operation in support of a building panel; and, FIG. 4 is a cross-sectional view taken along line 4—4 of FIG. 3; and, FIG. 5 is a side elevational view in partial section of an alternative embodiment of the invention.

With particular reference to FIG. 3, it can be seen that the lever 14 includes a pedal portion 24 sized to receive the boot of a worker and the locking device includes a second pedal portion 26 at a first end portion. The first and second pedal portions 24, 26 are sized and positioned so that the workboot can apply a concurrent bias to both pedal portions during the selected positioning of the tool. The locking device 18 includes an intermediate portion 30, which operates as a slide or jamming wedge through the aperture 20 to ultimately achieve a pinch lock of the lever 14 in the selected position. The pinch lock is achieved because the other end portion of the locking device 18 includes a base engaging end 31, including an arcuate bend 34, disposed to align the terminal end 32 of the locking device substantially flush against a top wall 36 of the base 12.

More particularly, the pinch lock is obtained because the aperture 30 comprises a slot in a top wall of the lever 14, having first and second oppositely spaced engagement points 42, 44 for locking contact of the jamming wedge portion of the locking device which locks because of the further engagement of a point 45 of the terminal end 32 of the locking device end against the top wall of the base 36. Thus, when the weight of the operator can be removed by removal of the boot from the first and second pedal portions 24, 26 the weight of the building panel 50 will continue to apply a pressure bias on the lever so that the pressure engagements are maintained at the pressure points 42, 44, 45. It is a combination of these three pressure points as bases for mechanical support which results in the simple locking mechanism of the subject invention.

In operation, it can be seen that the building panel 50 is initially lifted by pivoting the lever 14 on the pin 16 so that an angularly configured seat 54 disposed to receive and support the wallboard will operate to lift and position the board into a selected position. The further bias of the single foot of a worker against the locking device pedal portion 26 will urge the slide 30 through the lever aperture 20 and further urge the terminal edge of the locking device 32 on the top wall of the base 36 away from the pin 16. A stress will result in the bend portion 34 of the locking device to enhance the security of the lock at the engagement points 42, 44 and against the base top wall 36. The lock can then be maintained when the weight of the worker's foot is removed because the weight of the panel 50 will, similarly, operate to bias and maintain the lock at the engagement points.

With continued reference to FIG. 3, it can be seen that the slide portion 30 of the locking device is relatively angularly disposed in the aperture 20, so that the first and second engagement points are spaced along opposite sides of the slide 30 to facilitate the pinch locking of the lever member at the selected position. The elongate extension of the slide 30 provides for an infinite number of contact points against the engagement points of the lever aperture as the terminal end 32 of the locking device correspondingly slides both away from and towards the pivot point during the raising of the panel or the lowering of the lever seat 54 after its fastening.

The release of the locking device is achieved by a slight knock of the workboot against the side of the pedal portion 26 to jar it from its locked position so that the locking device will be released and able to slide from the lock engagements points. The terminal end 32 will slide towards the pivot and the seat 54 will fall.

Figure 4:
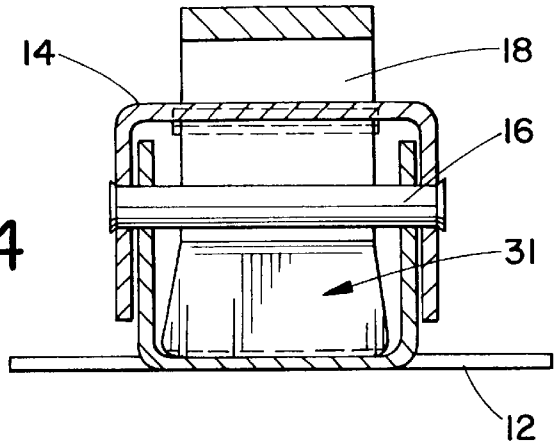

With reference to FIG. 4, it can be seen that the width dimension of the base engaging end 31 of the locking device 18 is flared to a size to preclude the locking device from falling out of the aperture 20 during normal operation. At assembly, the locking device 18 is inserted through the aperture 20 by its pedal portion first and then the lever and locking device combination is assembled to the base member 12 with the pivot 16.

Figure 5:
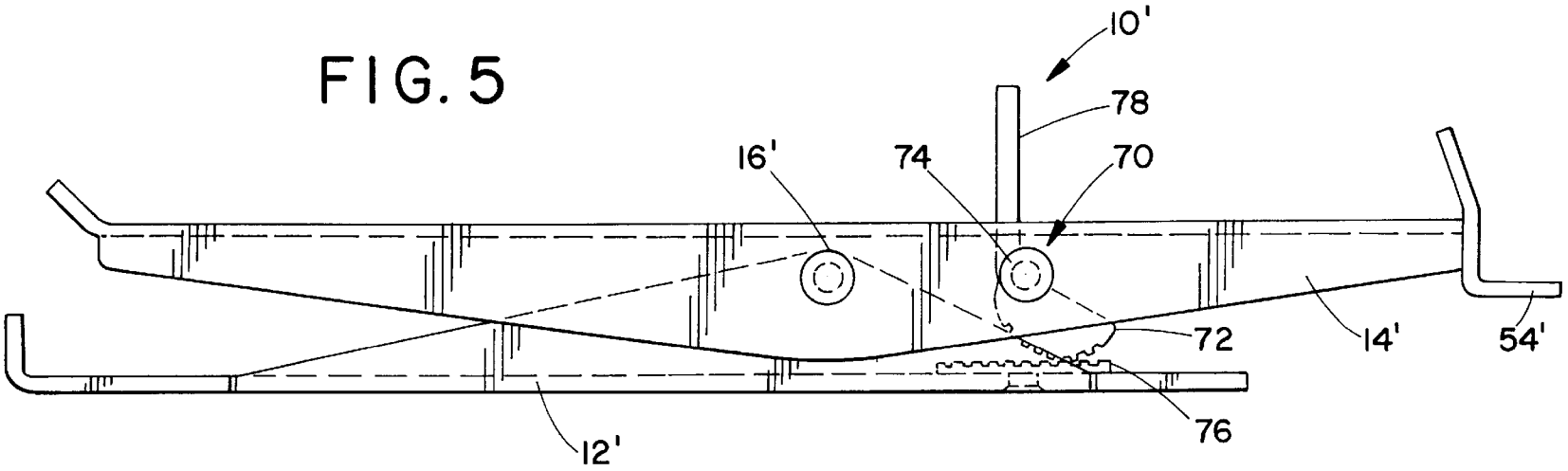

With reference to FIG. 5, an alternative embodiment of the invention is shown wherein like elements to the embodiment of FIG. 1 are identified with the same numerals and a primed suffix ('). In this embodiment, an alternative means for locking the lever member in a selected position relative to the base member comprises a jamming wedge 70 including a pawl and ratchet assembly. Rotatable pawl 72 is mounted on a pin 74 on the lever member 14' and is configured to gravitationally rotate towards the base member 12' as the panel seat 54' is raised. The ratchet plate 76 is fixed to the base member 12' opposite of the pawl 72 for locking engagement between them when the teeth of the pawl 72 are urged against the teeth of the ratchet plate 76 by the weight of a panel mounted in the seat 54' pressing down on the lever member 14'. In operation, as the seat 54' is raised, the pawl 72 will rotate towards the plate 76 so that the locking engagement will occur when the seat 54' is raised to the selected position. At that point, the press of the workboot can be released from the lever member 14' and the selected position will be maintained by the locking engagement between the pawl 72 and the ratchet plate 76. A release arm 78, accessible by the workboot, can selectively release the pawl from the ratchet plate by rotating the arm 78 towards the pin 16'. The seat 54' would then fall, presumably after the panel has been securely fastened.

The invention has been described with reference to the preferred embodiments, obviously, modifications and alterations will occur to others upon the reading and understanding of this specification. It is our intention to include all such modifications and alterations insofar as they come within the scope of the appended claims or the equivalents thereof. In particular, the invention has been described with reference to a slide mechanism which provides an infinite number of locking engagement points. Alternatively, a ratchet mechanism could be employed which would provide specific step points for locking the lever member at selected positions, but would lack the infinite number of selected positions provided by the preferred embodiment of the invention.

Having thus described our invention, we now claim:

1. A lift tool to position and support a work item vertically during installation while fastening devices are put in place, comprising:

a base member, a pivoting lever member supported by a pivot in said base member and a locking device means for locking the lever member at a selected position relative to the base member;

wherein the lever member includes a pedal portion sized to receive a workboot of a worker and the locking device means includes a wedge received through a wedge aperture in the lever member configured to obtain a lock of the wedge relative to the lever member in cooperation with the base member and lever member when bias by the workboot on the pedal portion raises the lever member, adjusts the position of the wedge relative thereto and locks the lever member at the selected position relative to the base member.

2. The lift tool as defined in claim 1 wherein the wedge includes a second pedal portion at a first end portion, a slide at an intermediate portion and a base member engaging end at a second end portion, wherein the slide comprises an elongate member received through the wedge aperture so that an infinite number of locking positions can be achieved by the tool whereby when the bias is concurrent against the pedal portion and the second pedal portion said tool is infinitely adjustable to the selected position.

3. The lift tool as defined in claim 2 wherein the base engaging end includes an arcuate bend disposed to align a terminal end of the wedge substantially flush against a top wall of the base member.

4. The lift tool as defined in claim 3 wherein the wedge aperture comprises a slot in a top wall of the lever member having first and second oppositely spaced engagement points for locking contact of the wedge which in combination with locking contact of the terminal end of the wedge against the top wall of the base member maintain the selected position when the lever member is pressed against the wedge from a weight of the work item.

5. The lift tool as defined in claim 2 wherein the second end portion is flared to a size greater than the wedge aperture.

6. The lift tool as defined in claim 1 wherein the lever member includes an angularly configured seat disposed to receive and support the work item.

7. An infinitely positionable jacking device operable with respect to positioning and locking in a selected position with a single foot of a worker comprising a base having a pivot, a pivotable lever member supported on the base at the pivot and a locking member disposed in cooperation with the lever member and the base to lock the lever member at the selected position, wherein the locking member includes a terminal end sized to engage the base, a slide and a locking member pedal portion and the lever member includes a lever pedal portion, an aperture to receive the slide for pivoting movement of the lever member about the pivot while the aperture translates across the slide and a workpiece support portion opposite of the lever pedal portion, and whereby the jacking device is locked in the preselected position by first concurrent biasing of the lever pedal portion and the locking member pedal portion by the foot of the worker until the lever member is pivoted to the selected position, and the slide is pinch locked in the aperture and the terminal end engages the base, wherein the foot can be removed and a weight of the workpiece will bias the jacking device to remain locked in the selected position.

8. The jacking device as claimed in claim 7 wherein the aperture includes first and second engagement points for the lever member and the lever member is angularly received in the aperture so that the engagement points are relatively spaced along the slide to facilitate pinch locking of the lever member at the selected position.

9. The jacking device as claimed in claim 7 wherein the lever member terminal end is angularly disposed relative to the slide for substantially flush engagement against the base to preclude relative slippage therebetween when the jacking device is at the selected position.

10. The jacking device as claimed in claim 7 wherein the terminal end of the locking member is sized to preclude passage through the aperture.

11. A lift tool adapted to position and support a work item vertically during installation, comprising:

a base member, a pivoting lever member supported by a pivot in said base member and a means for locking the lever member at a selected position relative to the base member;

wherein the lever member includes a pedal portion sized to receive a workboot of a worker and the means for locking comprises a jamming wedge associated with the lever member whereby bias by the workboot on the pedal portion raises the lever member to the selected position and the jamming wedge is dependently adjusted in relative position to both the lever member and the base member to support and lock the lever member at the selected position.

12. The lift tool as defined in claim 1 wherein said lock of the wedge relative to the lever member is releasable by a knock of the workboot against the wedge to jar the wedge thereby comprising a quick-release thereof.

13. The lift tool as defined in claim 11 wherein the jamming wedge comprises a pawl and ratchet assembly including a rotatable pawl pivotally mounted on the lever member and a ratchet plate fixed to the base member.

14. The lift tool as defined in claim 13 wherein the rotatable pawl includes a release arm accessible by the workboot to selectively release the pawl from the ratchet plate.

15. The lift tool as defined in claim 13 wherein the rotatable pawl is configured to gravitationally rotate towards the ratchet plate for locking engagement therewith as the lever member is raised.

* * * * *